US009468294B2

(12) United States Patent
Fu

(10) Patent No.: US 9,468,294 B2
(45) Date of Patent: Oct. 18, 2016

(54) STRUCTURE OF EXPANDABLE CORRUGATED STORAGE SHELF SYSTEM

(71) Applicant: BESTMATE INTERNATIONAL DEVELOPING CO., LTD., Yilan County (TW)

(72) Inventor: Kuang-Huan Fu, Yilan County (TW)

(73) Assignee: BESTMATE INTERNATIONAL DEVELOPING CO., LTD., Yilan County (TW)

( * ) Notice: Subject to any disclaimer, the term of this patent is extended or adjusted under 35 U.S.C. 154(b) by 36 days.

(21) Appl. No.: 14/613,340

(22) Filed: Feb. 3, 2015

(65) Prior Publication Data

US 2016/0220022 A1 Aug. 4, 2016

(51) Int. Cl.
*A47B 96/02* (2006.01)
*A47B 57/34* (2006.01)

(52) U.S. Cl.
CPC ..... *A47B 96/024* (2013.01); *A47B 57/34* (2013.01)

(58) Field of Classification Search
CPC .. A47B 57/265; A47B 57/545; A47B 57/34; A47B 57/26; A47B 57/54; A47B 57/48; A47B 47/0083; A47B 47/045; A47B 47/024; A47B 87/0223; A47B 87/023; A47B 87/0238; A47B 2087/023; A47B 2087/0238; A47B 96/024; F16B 7/048
USPC ..... 211/188; 108/147.13, 190, 192
See application file for complete search history.

(56) References Cited

U.S. PATENT DOCUMENTS

| | | | | | |
|---|---|---|---|---|---|
| 4,318,352 | A * | 3/1982 | Friedman | A47B 57/265 | 108/107 |
| 4,582,001 | A * | 4/1986 | Leikarts | A47B 57/265 | 108/106 |
| 4,627,543 | A * | 12/1986 | Nicely | A47B 57/265 | 108/147.13 |
| 4,656,952 | A * | 4/1987 | Schweizer | A47B 57/265 | 108/11 |
| 6,044,988 | A * | 4/2000 | Yang | A47B 57/265 | 108/107 |
| 6,068,143 | A * | 5/2000 | Wang | A47B 57/265 | 108/144.11 |
| 6,253,687 | B1 * | 7/2001 | McAllister | A47B 57/545 | 108/107 |

(Continued)

*Primary Examiner* — Patrick Hawn
(74) *Attorney, Agent, or Firm* — Leong C. Lei

(57) ABSTRACT

A structure of expandable corrugated storage shelf system includes a support frame and coupling sleeves or retention plates, or coupling sleeves and retention plates, arranged at side surfaces of the support frame. The coupling sleeves each have an outer surface on which symmetrically arranged engagement slots are formed and convergent, through sloping, in a downward direction. The retention plates each have a curved configuration are convergent, through sloping, in the downward direction. To assemble, the coupling sleeves of a plurality of support frames are respectively fit to fixed rods to receive the retention plates of an adjacent one of the support frames to fit into the engagement slots of the coupling sleeves thereby connecting the plurality of support frames together in a side by side manner or forming a corner configuration and expansion of the storage shelf being made easy and being tidy and organized after being connected together.

4 Claims, 8 Drawing Sheets

(56) References Cited

U.S. PATENT DOCUMENTS 6,253,933 B1 * 7/2001 Yang ..... A47B 57/545 108/147.12
6,257,426 B1 * 7/2001 Masunaka ..... A47B 46/00 108/107
6,302,284 B1 * 10/2001 Zonshin ..... A47B 47/0083 108/147.11
6,357,611 B1 * 3/2002 Chen ..... A47B 57/26 108/107
6,364,138 B1 * 4/2002 Chen ..... A47B 57/26 108/147.13
6,695,156 B1 * 2/2004 Wang ..... A47B 57/265 108/147.11
6,748,878 B2 * 6/2004 Chen ..... A47B 57/265 108/147.13
7,059,484 B1 * 6/2006 Goldberg ..... A47B 47/0083 211/153
7,093,728 B2 * 8/2006 Chen ..... A47B 57/545 211/153
7,478,971 B2 * 1/2009 Li ..... A47B 57/545 108/147.13
7,543,540 B2 * 6/2009 Tatematsu ..... A47B 47/047 108/192
8,016,140 B2 * 9/2011 Hsieh ..... A47B 47/0083 211/187
8,376,156 B2 * 2/2013 Jarvis ..... A47B 47/045 108/147.12
8,376,157 B2 * 2/2013 Jarvis ..... A47B 47/045 108/147.12
8,505,751 B2 * 8/2013 Shinozaki ..... A47B 47/0083 108/147.13
8,505,752 B2 * 8/2013 Shinozaki ..... A47B 47/0083 108/147.13
8,627,966 B2 * 1/2014 Jarvis ..... A47B 55/00 211/187
8,651,300 B2 * 2/2014 Chen ..... A47B 47/024 108/107
8,678,207 B2 * 3/2014 Shimazaki ..... A47B 57/545 108/147.13
8,757,400 B2 * 6/2014 Bosch ..... B01L 9/06 211/126.12
8,887,647 B2 * 11/2014 Sabounjian ..... A47B 57/10 108/147.13
9,167,915 B1 * 10/2015 Lau ..... A47B 47/0083
9,192,250 B2 * 11/2015 Maurer ..... A47F 5/01
9,249,818 B2 * 2/2016 Sabounjian ..... A47B 57/265
9,314,098 B2 * 4/2016 Sabounjian ..... A47B 47/0083
2007/0161280 A1 * 7/2007 Li ..... A47B 57/545 439/352
2010/0108631 A1 * 5/2010 McAllister ..... A47B 57/545 211/187

* cited by examiner

STRUCTURE OF EXPANDABLE CORRUGATED STORAGE SHELF SYSTEM

TECHNICAL FIELD OF THE INVENTION

The present invention generally relates to a structure of an expandable corrugated storage shelf system, and more particularly to a structure of an expandable corrugated storage shelf system that, through an easy way of coupling to connect a plurality support frames in a side-by-side manner, allows for easy assembling and expansion of storage shelves through side-by-side arrangement and provides a tidy assembled configuration.

DESCRIPTION OF THE PRIOR ART

A conventional knockdown storage shelf generally has a structure that is assembled as illustrated in FIG. 1, comprising a fixed rod 1, clamping plates 2, and a support frame 3. Grooves 11 are provided on the fixed rod at a suitable interval by circumferentially formed in a surface thereof. The clamping plates 2 each have an inside surface on which a retention rib 21 is formed. The support frame 3 has a corner on which a coupling sleeve 31 is attached. To assemble, the clamping plates 2 are positioned with the retention ribs 21 thereof fit into one of the grooves 11 of the fixed rod 1 and then, the coupling sleeve 31 is fit, in a direction from top down, so that the coupling sleeve 31 clamp and tightly loop around the clamping plates 2 thereby fixing the coupling sleeve 31 in position and thus the support frame 3 is coupled to the fixed rod 1 (where four fixed rods 1 are provided to constitute the storage shelf). Balance is generally hard to control in assembling the conventional storage shelf so that it is hard to assemble with a single person. In addition, such a structure is generally only good for forming a single storage shelf so that when multiple storage shelves are arranged side by side for expansion, they cannot be securely coupled and positioned with respect to each other. Further, gaps exist between the storage shelves, making it hard to keep the individual storage shelves in a tidy and organized manner, and thus the outside appearance is poor. Unexpected shifting may occur when these storage shelves are violently hit. Thus, in view of these problems, the present invention aims to provide a structure of an expandable corrugated storage shelf system that allows for easy assembling and expansion through side-by-side arrangement and provides a tidy configuration after assembly.

SUMMARY OF THE INVENTION

The primary object of the present invention is to provide a structure of an expandable storage shelf system that allows multiple storage shelves to be connected in a side-by-side manner through simple coupling to achieve easy assembling and expansion of the storage shelves through side-by-side arrangement and provides a tidy assembled configuration.

The structure of expandable corrugated storage shelf system according to the present invention comprises a support frame and coupling sleeves or retention plates, or coupling sleeves and retention plates, arranged at side surfaces of the support frame, wherein the coupling sleeves each have an outer surface on which symmetrically arranged engagement slots are formed, where the coupling sleeves are made convergent, through sloping, in a downward direction, and the retention plates each have a curved configuration, where the retention plates are made convergent, through sloping, in the downward direction. To assemble, the coupling sleeves of a plurality of support frames are respectively fit to fixed rods to receive the retention plates of an adjacent one of the support frames to fit into the engagement slots of the coupling sleeves thereby connecting the plurality of support frames together in a side by side manner or forming a corner configuration and expansion of the storage shelf being made easy and being tidy and organized after being connected together.

In the above structure of expandable corrugated storage shelf system, the engagement slots formed on outer circumferential surfaces of the coupling sleeves are each formed in such a way that the coupling sleeve is subjected to stamping to form in a circumferential wall thereof horizontal U-shaped openings, which are each gradually convergent, through side sloping, in a downward direction and a portion of the circumferential wall is stamped off as a partially separated plate with a connection left between the separated plate portion and the circumferential wall of the coupling sleeve, the connection being folded outward so as to form an L-shaped suspending tab, two such suspending tabs being arranged in opposite directions to collectively define the engagement slot.

In the above structure of expandable corrugated storage shelf system, the retention plates each comprise two hooks extending horizontally and outwardly from upper ends of opposite side edges thereof in such a way that the hooks are positionable on top edges of suspending tabs of the corresponding coupling sleeve.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
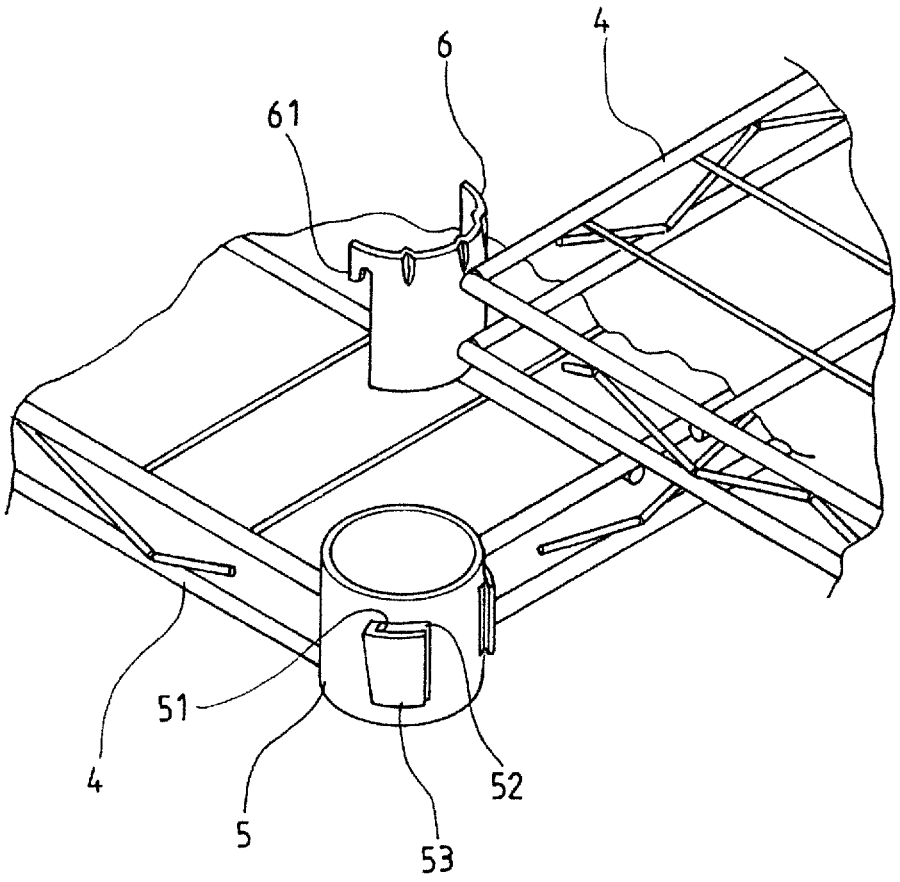
FIG. 2 is an exploded view of the present invention.
Figure 3:
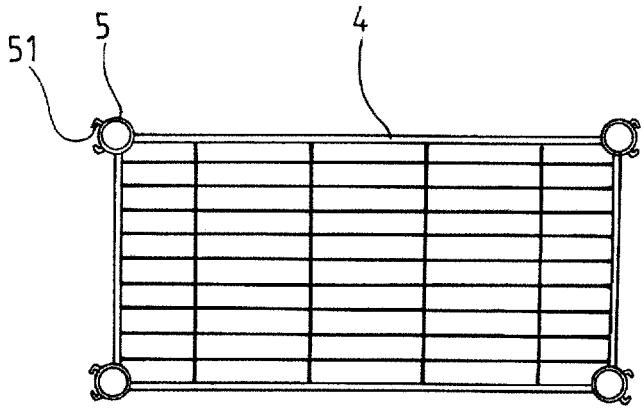
FIGS. 3 and 4 are top plan views of the present invention.
Figure 4:
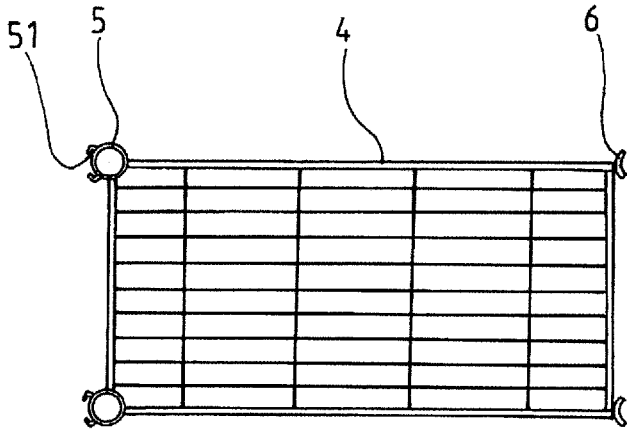

Referring collectively to FIGS. 2, 3, and 4, which are respectively an exploded view and top plan views of the present invention, as shown in the drawings, the present invention comprises a support frame 4 and coupling sleeves 5 and retention plates 6, or alternatively, coupling sleeves 5 or retention plates 6, which are arranged at four corners, alternatively at corners and outer surfaces, of the support frame 4. The coupling sleeve 5 is in the form of a hollow cylindrical configuration and has an outer circumferential surface on which at least one engagement slot 51 is formed. In the instant embodiment, the engagement slot 51 is formed in such a way that the coupling sleeve 5 is subjected to stamping to form in a circumferential wall thereof a horizontal U-shaped opening 52, which is gradually convergent, through side sloping, in a downward direction. A portion of the circumferential wall is stamped off as a partially separated plate, where a connection is left between the separated plate portion and the circumferential wall of the coupling sleeve 5. The connection is folded outward so as to form an L-shaped cross-section so that the separated plate is supported by the L-shaped connection to form a suspending tab 53 having an L-shaped configuration. Two such L-shaped suspending tabs 53 are formed to face opposite directions and the engagement slots 51 that are convergent, through side sloping, in the downward direction. The retention plate 6 has a curved configuration that corresponds to the cylindrical configuration of the coupling sleeve 5 and is made convergent, through side sloping, in a downward direction. Two hooks 61 are formed on and extend horizontally from upper ends of opposite side edges of the retention plate 6.

In the instant embodiment of the present invention, four coupling sleeves 5 are respectively set at the four corners of the support frame 4; alternatively, four retention plates 6 are respectively set at the four corners of the support frame 4; or alternatively, two coupling sleeves 5 are at two of the four corners of the support frame 4 and two retention plates 6 are set at the remaining two corners.

With the components described above, the coupling sleeves 5 of a number of support frames 4 are respectively fit to fixed rods of storage shelves in such a way that the engagement slots 51 of the coupling sleeves 5 receive the retention plates 6 of the support frame 4 at one side to be fit therein with the hooks 61 supported on top edges of the suspending tabs 53 and the retention plates 6 are received into the coupling sleeves of the support frame 4 at an opposite side, whereby through mutual coupling engagement between the retention plates 6 and the coupling sleeves 5, a number of support frames 4 can be connected together in a side-by-side manner or forming a corner configuration. The assembly of the storage shelf easy and efficient (for it can be easily kept balanced to allow the assembly to be carried out by a single person) and allows for multiple storage shelves to be connected in a side-by-side manner for expansion and the expanded arrangement is made tidy and organized.

Figure 1:
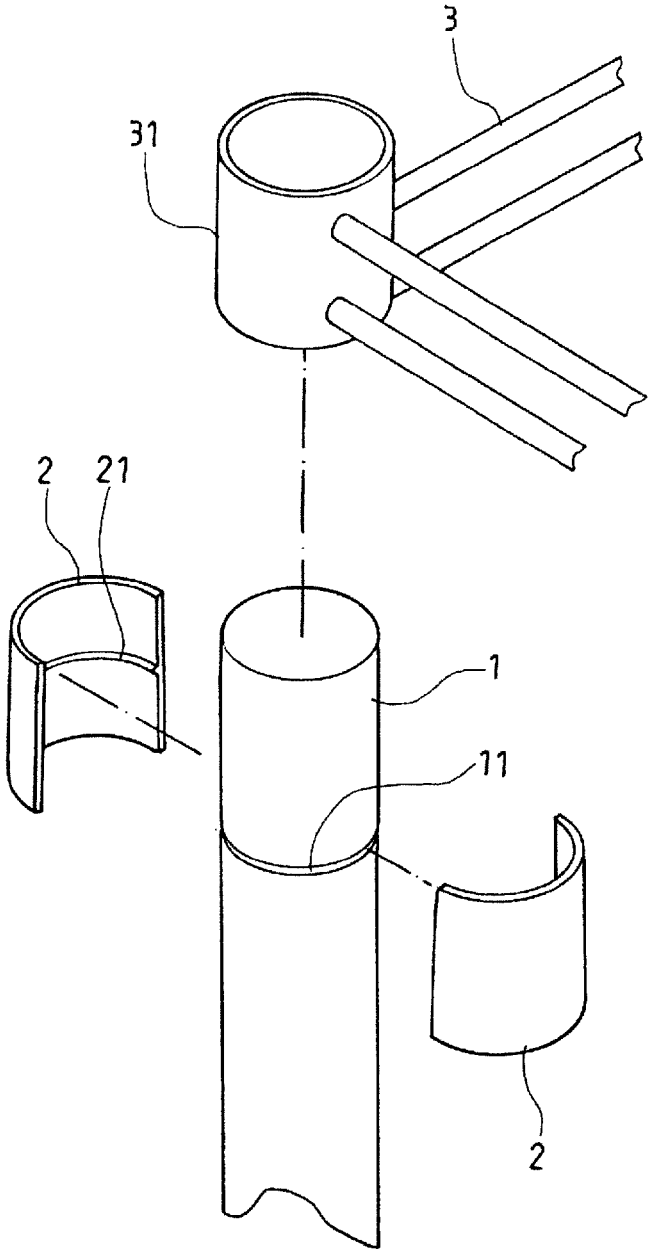
PRIOR ART FIG. 1
FIG. 1 is an exploded view showing a conventional storage shelf.
Figure 5:
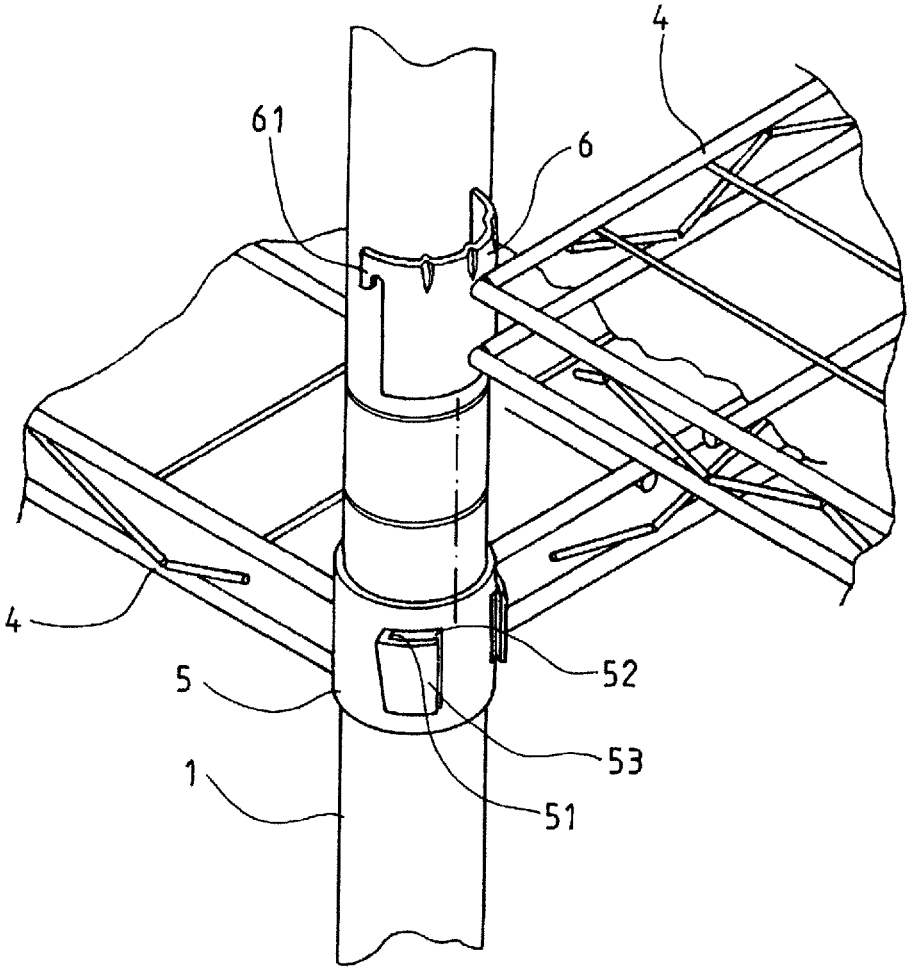
FIG. 5 is a schematic view illustrating assembly of the present invention.
Figure 6:
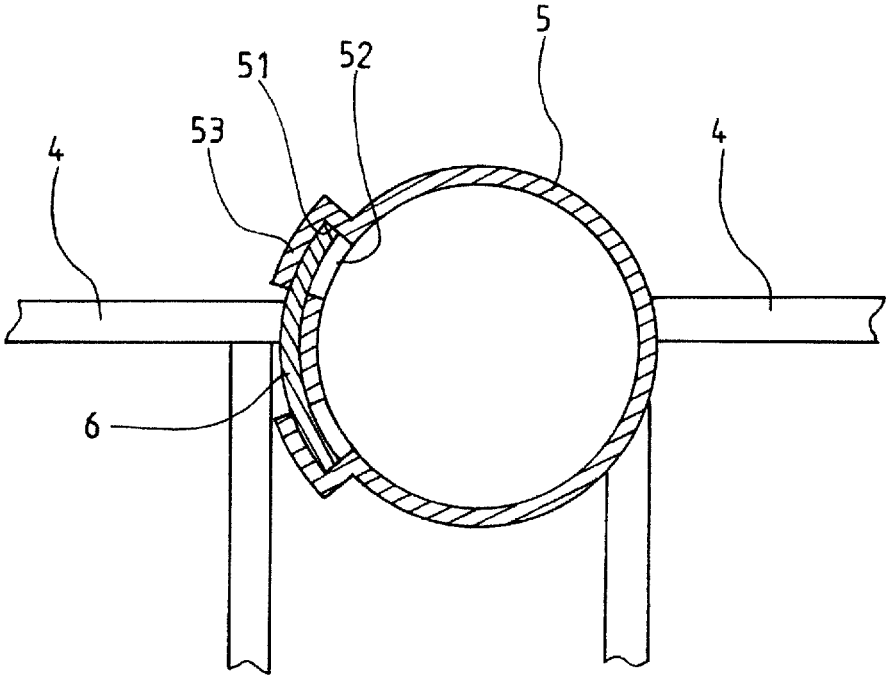
FIG. 6 is a schematic view illustrating coupling engagement between a coupling sleeve and a retention plate of the present invention.

Referring collectively to FIGS. 5 and 6, which are respectively a schematic view illustrating the assembly of the present invention and a schematic view illustrating coupling engagement between a coupling sleeve and a retention plate of the present invention, as shown in the drawings, assembling of the present invention can be conducted in a way similar to that of the above described conventional storage shelf shown in FIG. 1 by first having retention ribs 21 of clamping plates 2 fit into a groove 11 formed in an outer surface of each of the fixed rods 1 and then the coupling sleeve 5 of one support frame 4 is fit in a top side down manner to allow the coupling sleeve 5 to clamp and tightly loop the clamping plates 2 so as to fix the coupling sleeve 5 in position. The retention plate 61 of another support frame 4 that is located at one side is then fit into the engagement slots 51 of the coupling sleeve 5. Since the engagement slot 51 is made convergent, through sloping, in a downward direction and the retention plate 6 is also made convergent, through sloping, in the downward direction, the retention plate 6, after being properly fit into the coupling sleeve, is securely fastened to each other due to the sloping and convergence (allowing for sliding upward only and preventing further downward sliding) with the hooks 61 supported on top edges of the suspending tabs 53 so as to have a number of support frames 4 connected together in a side-by-side manner. The assembly of the storage shelf is easy and efficient and allows for multiple storage shelves to be connected in a side-by-side manner for expansion and the expanded arrangement is made tidy and organized.

Figure 7:
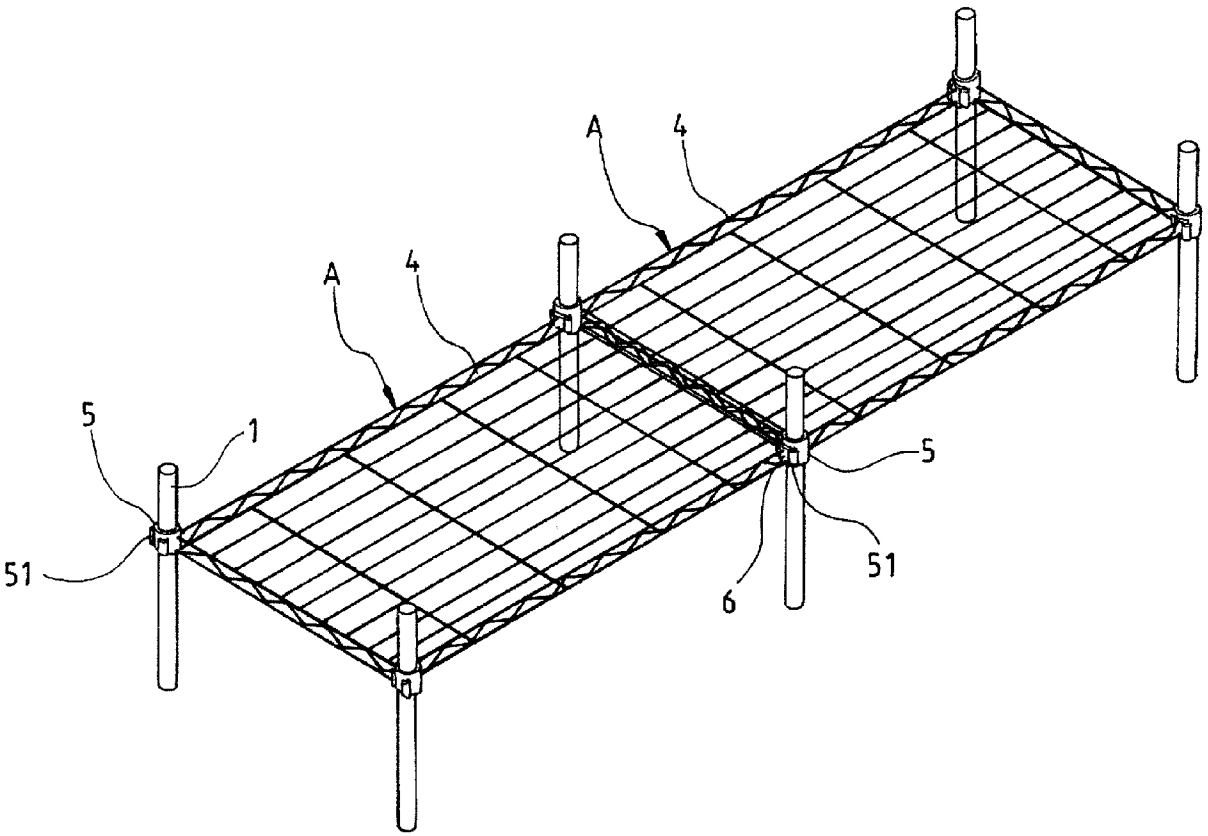
FIG. 7 is a perspective view illustrating a storage shelf according to the present invention.

Referring to FIG. 7, a perspective view is given to illustrate a storage shelf according to the present invention. Reference also being had to FIG. 2, as shown in the drawings, after one unit of storage shelf A according to the present invention is completely assembled, in case that expansion or extension of the storage shelf is required, it only needs to assemble another support frame 4 to the fixed rods 1 in such a way that the retention plate 6 of the support frame 4 is fit into the engagement slot 51 of the coupling sleeve 5 of the storage shelf A. As such, the storage shelf A and said another storage shelf A are connected in such a way that the two storage shelves A are arranged side by side. Through such a way of assembly, a plurality of storage shelves A can be connected to provide unlimited expansion and the side-by-side arranged storage shelves A show no gap therebetween, making them look tidy, and due to the storage shelves A are tightly and closed fixed together and are not unexpectedly shifted when hit or impacted to affect the outside appearance thereof.

Figure 8:
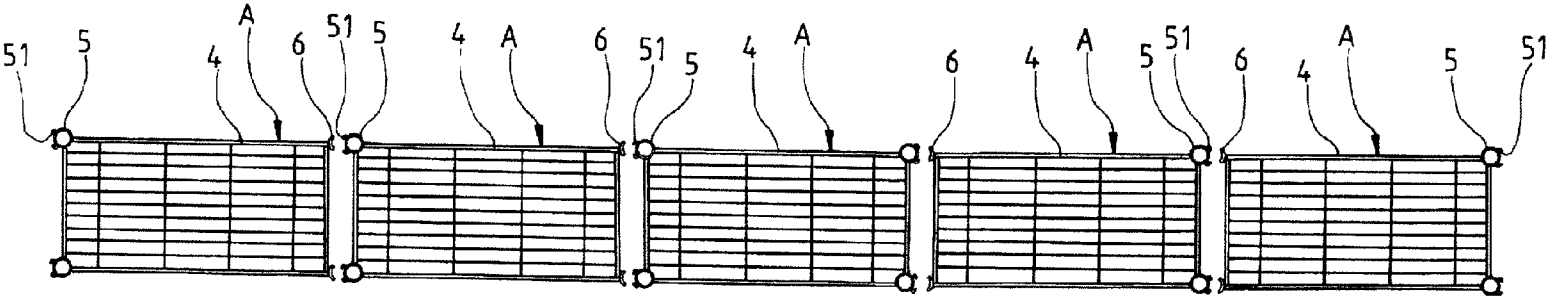
FIG. 8 is a schematic view illustrating one arrangement of expansion of the present invention.

Referring to FIG. 8, which is a schematic view illustrating an arrangement of expansion of the present invention. Reference also being had to FIG. 2, as shown in the drawings, to assemble the present invention, the retention plates 6 of each of support frames 4 are individually fit into the engagement slots 51 of the coupling sleeves 5 of a next one of the support frames 4 (wherein one of the support frames 4 comprises coupling sleeves 5 set at the four corners thereof, while the remaining ones of the support frames 4 comprise coupling sleeves 5 set at two corners thereof and retention plates 6 at the remaining two corners). As such, through a simple and easy assembling operation, a plurality of storage shelves 4 can be connected together with expansion being available in a unlimited manner.

Figure 9:
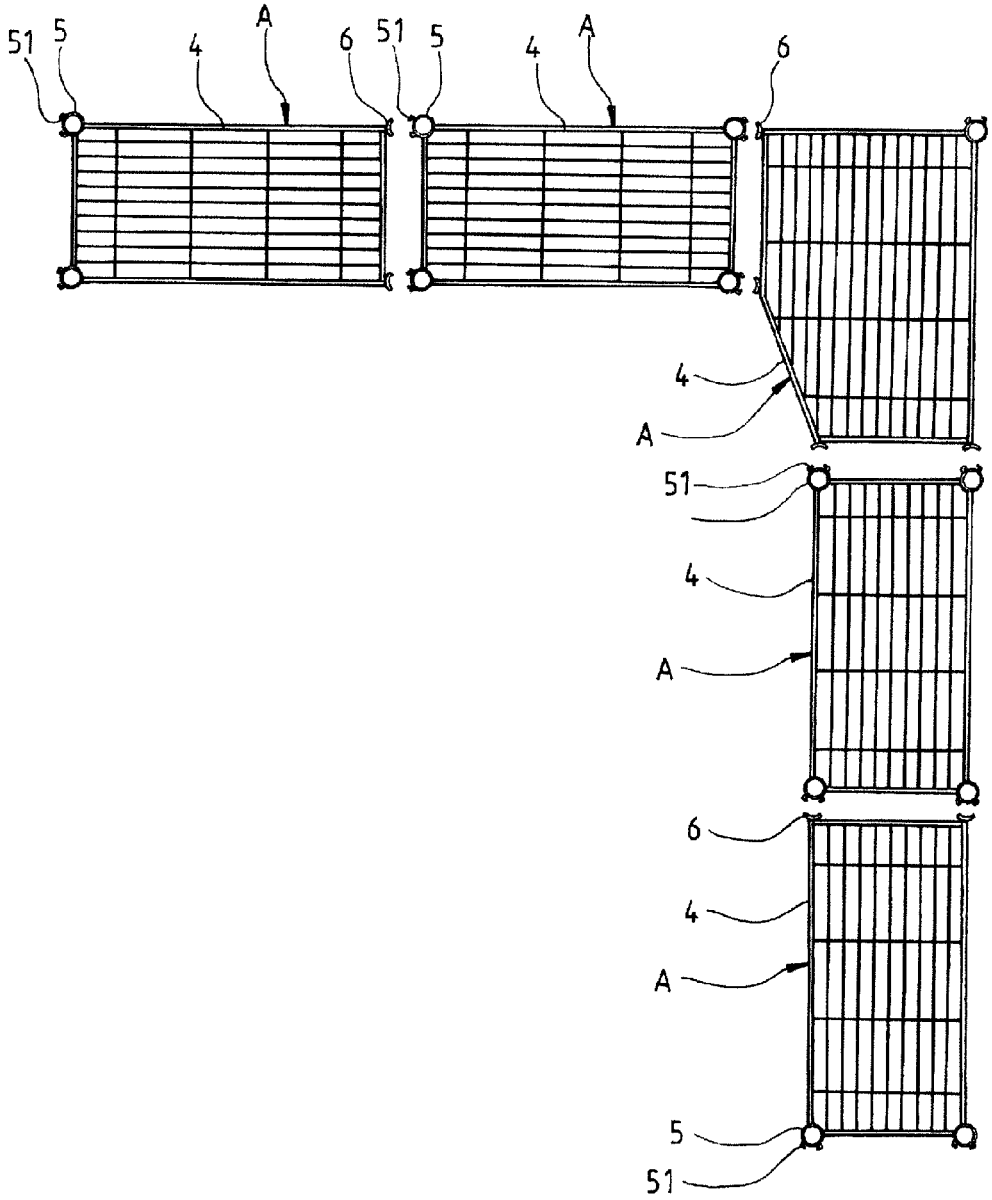
FIG. 9 is a schematic view illustrating another arrangement of expansion of the present invention.

Referring to FIG. 9, which is a schematic view illustrating another arrangement of expansion of the present invention. Reference also being had to FIG. 2, as shown in the drawings, except the example illustrated in FIG. 8, where a plurality of storage shelves are combined to expand in a linear manner, another type of support frame 4A is provided, wherein four corners and side surfaces of the support frame 4A are respectively provided with coupling sleeves 5 and retention plates 6. In a similar way, the retention plates of each of a plurality of support frames 4 can be individually fit into the engagement slots 51 of the coupling sleeves 5 of a next one of the support frames 4 so that the support frame 4A allows the plurality of support frames 4 to form an L-shaped corner configuration of expansion, wherein one side of the support frame 4A can be made sloping to facilitate access to articles placed on the storage shelf A.

The above examples are given to illustrate preferred embodiments of the present invention, but not intending to limit the scope of the present invention. Minor modification and alterations, which are made without departing from the gist of the present invention, are considered within the scope of the present invention.

In summary, the present invention provides a support frame that is provided with coupling sleeves and retention plates, wherein the coupling sleeves and the retention plates are respectively provided with engagement slots and hooks, to constitute a structure of an expandable corrugated storage shelf system, which allows for easy and efficient assembly of the storage shelf and provides an easy way of side by side arrangement and also makes the expansion that is made through side by side arrangement tidier and more organized.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of expandable corrugated storage shelf system, comprising a first support frame that comprises a coupling sleeve mounted thereto and a second support frame that comprises a retention plate mounted thereto, wherein the coupling sleeve is adapted to fit over an upright fixed rod to be retained thereon and has a cylindrical outer surface on which symmetrically arranged engagement slots are formed to be spaced from each other circumferentially, each of two engagement slots being formed of a suspending tab having an L-shaped cross-section that comprises a support plate spaced from the cylindrical outer surface of the sleeve in a radial direction and having two spaced vertical edges opposite to each other and a connection plate substantially perpendicular to the support plate and connecting one of the two vertical edges of the support plate that is distant from the other support plate to the outer surface of the coupling sleeve such that the opposite one of the vertical edge that is adjacent to the other support plate is spaced from the outer surface of the coupling sleeve and is kept open, the support plate having a top edge that is spaced from the outer surface of the coupling sleeve and being kept open, wherein the connection plates of the two suspending tabs are circumferentially spaced from each other to define therebetween a receiving space and the connection plates are inclined toward each other in a downward direction such that a circumferential spacing distance between the connection plates is decreased from top ends of the connection plates to bottom ends of the connection plates, making the receiving space convergent in the downward direction to be wider in the circumferential direction in a top end and narrower in a bottom end; and wherein the retention plate has a curved configuration corresponding to the cylindrical outer surface of the coupling sleeve and receivable in the receiving space of the coupling sleeve of the first support frame to have the first and second support frames connected to each other and coupled to the fixed rod, wherein the retention plate has opposite vertical edges that are spaced from each other in the circumferential direction and are sloping such that the vertical edges of the retention plates are convergent toward each other in the downward direction and respectively engageable with the connection plates of the suspending tabs of the coupling sleeve of the first support frame by means of the sloping thereof being substantially the same angle with the inclination of the connection plates of the suspending tabs of the coupling sleeve of the first support frame so that the first and second support frames are connectable together for expansion of the storage shelf.

2. The structure of expandable corrugated storage shelf system according to claim 1, wherein the retention plates each comprise two hooks extending horizontally and outwardly from upper ends of the two opposite vertical edges thereof in such a way that the hooks are positionable on the top ends of the connection plates of the suspending tabs of the coupling sleeve.

3. The structure of expandable corrugated storage shelf system according to claim 1, wherein the first support frame comprises sides and corners jointing the sides and the coupling sleeves mounted to the corners or outside surfaces of the sides of the first support frame.

4. The structure of expandable corrugated storage shelf system according to claim 1, wherein the second support frame comprises sides and corners jointing the sides and the retention plate are mounted to the corners or outside surfaces of the sides of the second support frame.

* * * * *